US008133432B2

(12) United States Patent
Hasegawa

(10) Patent No.: US 8,133,432 B2
(45) Date of Patent: Mar. 13, 2012

(54) CONDUCTIVE MATERIAL

(75) Inventor: Koichi Hasegawa, Soka (JP)

(73) Assignee: Ishifuku Metal Industry Co., Ltd., Tokyo (JP)

( * ) Notice: Subject to any disclaimer, the term of this patent is extended or adjusted under 35 U.S.C. 154(b) by 0 days.

(21) Appl. No.: 12/472,554

(22) Filed: May 27, 2009

(65) Prior Publication Data

US 2009/0297389 A1 Dec. 3, 2009

(30) Foreign Application Priority Data

May 28, 2008 (JP) ..... 2008-140169

(51) Int. Cl.
*C22C 5/04* (2006.01)

(52) U.S. Cl. ..... 420/466; 148/430

(58) Field of Classification Search ..... 420/466; 148/430

See application file for complete search history.

(56) References Cited

FOREIGN PATENT DOCUMENTS

| | | | |
|---|---|---|---|
| JP | 2001335862 A | * | 12/2001 |
| JP | 2004093199 A | * | 3/2004 |
| JP | 4251517 B2 | | 1/2009 |

* cited by examiner

*Primary Examiner* — Roy King
*Assistant Examiner* — Janelle Morillo
(74) *Attorney, Agent, or Firm* — Browdy and Neimark, PLLC

(57) ABSTRACT

Provided is a conductive material to be used for a resistor and a sensor, which is enhanced its mechanical strength while maintaining a stable resistance ratio. In the conductive material used for the resistor and the sensor, 400 to 10,000 ppm of Sr is contained in Pt, and the balance is an inevitable impurity. An intermetallic compound phase formed of Pt and Sr is precipitated and dispersed in Pt.

2 Claims, 1 Drawing Sheet

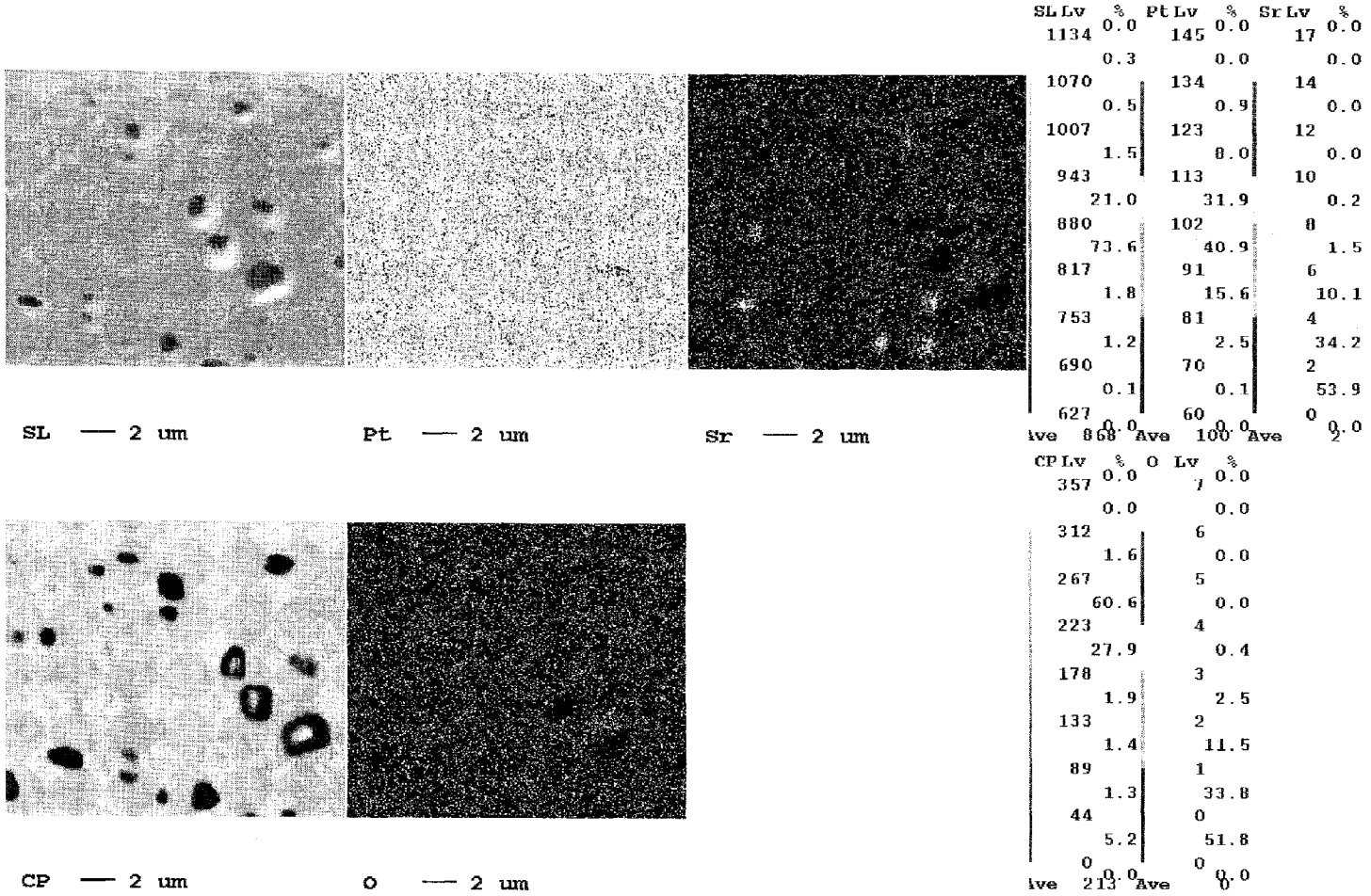
SL Lv % Pt Lv % Sr Lv %
1134 0.0 145 0.0 17 0.0
0.3 0.0 0.0
1070 134 14
0.5 0.9 0.0
1007 123 12
1.5 8.0 0.0
943 113 10
21.0 31.9 0.2
880 102 8
73.6 40.9 1.5
817 91 6
1.8 15.6 10.1
753 81 4
1.2 2.5 34.2
690 70 2
0.1 0.1 53.9
627 60 0
Ave 868 Ave 100 Ave
CP Lv % O Lv %
357 0.0 7 0.0
0.0 0.0
312 6
1.6 0.0
267 5
60.6 0.0
223 4
27.9 0.4
178 3
1.9 2.5
133 2
1.4 11.5
89 1
1.3 33.8
44 0
5.2 51.8
0 0
Ave 213 Ave
SL — 2 um
Pt — 2 um
Sr — 2 um
CP — 2 um
O — 2 um

CONDUCTIVE MATERIAL

BACKGROUND OF THE INVENTION

1. Field of the Invention

The present invention relates to a conductive material used for a resistor and a sensor, which is enhanced its mechanical strength while maintaining a stable resistance ratio.

2. Description of the Related Art

Conventionally, conductive materials have been used in a gas sensor for flammable gas such as carbon monoxide and butane, which conducts the detection of the gas on the basis of a change in resistance while heating a catalyst by resistance heating. Further, in a thermistor and an oxygen sensor using a solid electrolyte, a lead for a sensor of gas such as carbon monoxide and nitrogen oxide, and a lead for a semiconductor gas sensor, conductive materials have been used, which are required to have a stable resistance at high temperatures and have enhanced mechanical strength by a solid solution such as Pt or a Pt—Rh alloy. Such conductive materials are not remarkably oxidized even in the atmosphere at high temperatures and have stable corrosion resistance.

Conductive materials to be used for the above-mentioned purposes are required to have excellent corrosion resistance and stable resistance at the temperature to be used. Such conductive materials are used in the form of a wire rod, a thin film produced by vapor deposition or sputtering, and a film obtained by printing and heating a paste or the like. In particular, when the conductive material is used as a wire rod, it is required to have mechanical strength at a certain level or higher. Further, depending upon the purpose, the conductive material is used as a wire rod with a diameter of 50 μm or less, which is required to have satisfactory workability, as well as corrosion resistance, heat resistance, and oxidation resistance. In order to satisfy those requests, Pt and a Pt—Rh alloy are used.

However, Pt has low mechanical strength, and in the case where Pt is heated in a high-temperature during the process, crystal grains become coarse. When bending is performed during the process, the crystal grains are broken from a grain boundary.

The mechanical strength may be enhanced by adding Rh or the like to Pt. However, due to the difference in vapor pressures, the composition change is occurred to vary a resistance. Thus, there is a problem that it cannot be used for the purpose in which the change in resistance is considered to be important.

In addition, Elements to be added are limited to those which are unlikely to be oxidized, and an element such as Rh which is more expensive than Pt needs to be used.

Further, in the case of enhancing the solid solution, Rh has a small effect of suppressing the coarsening of crystal grains. In the case where Rh is exposed to high temperatures of 1,500° C. or higher during the process, Rh is coarsened to an extent about the same as Pt and may be broken from the grain boundary.

Therefore, a material in which an oxide or the like is dispersed is used. However, it is difficult to form an extra fine wire of 50 μm or less from the material, and there are such problems that the material has ductility smaller than that of Pt and a Pt alloy, and the like.

SUMMARY OF THE INVENTION

The inventors of the present invention have conducted intensive studies in order to solve the above conventional problems, and hence have found a conductive material comprising: Pt; 400 to 10,000 ppm of Sr contained therein; and an inevitable impurity as the balance, wherein an intermetallic compound phase formed of Pt and Sr is dispersed and precipitated in Pt.

Note that when the addition amount of Sr is less than 400 ppm, Pt and Sr are not precipitated sufficiently as an intermetallic compound, and the mechanical strength becomes weak. Further, when the addition amount of Sr exceeds 10,000 ppm, the workability is decreased, and cracks and ruptures are caused during the process, with the result that an extra fine wire (with a diameter of 50 μm or less) cannot be formed. Then, in the present invention, the addition amount of Sr is set to be 400 to 10,000 ppm.

The conductive material of the present invention has a stable resistance ratio and high mechanical strength at high temperatures, suppresses the coarsening of crystal grains, and is excellent in workability. Further, the conductive material of the present invention has oxidation resistance and corrosion resistance, and the surface thereof is not to be covered with an oxide film even when exposed to a high temperature of 1,500° C. or higher.

The conductive material can be used in, for example: a resistance wire using a temperature coefficient; and a lead wire required to have a stable resistance at high temperatures in an oxygen sensor or the like.

BRIEF DESCRIPTION OF THE DRAWINGS

FIG. 1 shows surface analysis results by EPMA in Example 3.

DETAILED DESCRIPTION OF THE PREFERRED EMBODIMENTS

Hereinafter, the present invention is described by way of specific examples.

Table 1 shows a component composition of each of samples of Examples 1 to 4, Comparative Examples 1 and 2, and Conventional Examples 1 and 2. Pt and a Pt alloy with elements shown in Table 1 were melted in an argon gas atmosphere, and cast in a mold to obtain ingots, and then each ingot was forged and stretched. The workability, mechanical strength, and resistance ratio thereof were investigated.

Table 2 shows the investigation results of the workability and the mechanical strength.

TABLE 1

| | Sr (ppm) | Rh (mass %) | Pt (mass %) |
|---|---|---|---|
| Example 1 | 600 | — | bal. |
| Example 2 | 1,200 | — | bal. |
| Example 3 | 3,000 | — | bal. |
| Example 4 | 6,500 | — | bal. |
| Comparative Example 1 | 61 | — | bal. |
| Comparative Example 2 | 11,500 | — | bal. |
| Conventional Example 1 | — | — | bal. |
| Conventional Example 2 | — | 13 | bal. |

TABLE 2

| | Possibility of Working at ϕ30 μm | Tensile Strength (MPa) at Room Temp. *1 | Tensile Strength (MPa) at High-Temp. [600° C.] |
|---|---|---|---|
| Example 1 | Possible | 161 | 66.7 |
| Example 2 | Possible | 167 | 75.8 |
| Example 3 | Possible | 253 | 118 |

TABLE 2-continued

| | Possibility of Working at ϕ30 μm | Tensile Strength (MPa) at Room Temp. *1 | Tensile Strength (MPa) at High-Temp. [600° C.] |
|---|---|---|---|
| Example 4 | Possible | 245 | 126 |
| Comparative Example 1 | Possible | 131 | 46.8 |
| Comparative Example 2 | Impossible | — | — |
| Conventional Example 1 | Possible | 127 | 36.4 |
| Conventional Example 2 | Possible | 239 | 107 |

*1 Test after heat treatment at 1,550° C. for one hour.
Test Sample: wire rod of ϕ0.3 mm × L50 mm As shown in Table 2, stretching of a drawn wire of ϕ30 μm is possible in any of Examples 1 to 4. Further, compared with Pt in Conventional Example 1, the tensile strength in each Example is 1.3 times or more at room temperature, and is twice or more at 600° C. Thus each Example has sufficient tensile strength. Further, when Sr is 3,000 ppm or more (Examples 3 and 4), the tensile strength equal to or more than that of a PtRh alloy in Conventional Example 2 is obtained.

In order to confirm the stability of a resistance ratio $R_{100}/R_0$ (=Resistance at 100° C./Resistance at 0° C., abbreviated hereinafter), Examples 1 to 4 were heat-treated in the atmosphere at 600° C. for 500 hours, and the change rate in a resistance ratio before and after the heat treatment was investigated. The change rate of the resistance ratio was calculated from Expression 1.

Change rate of a resistance ratio (%)=[(Resistance ratio*2 BEFORE heat treatment −Resistance ratio AFTER heat treatment)/Resistance ratio BEFORE heat treatment]×100 Expression 1:

*2: Conditions before heat treatment:
ϕ0.3 mm×1,000 mm wire;
Measurement after heat treatment at 1,100° C. for 1 hour.
Table 3 shows the results.

TABLE 3

| | Change Rate of Resistance Ratio at 600° c. for 500 Hours |
|---|---|
| Example 1 | −0.01 |
| Example 2 | −0.01 |
| Example 3 | −0.01 |
| Example 4 | −0.02 |

The temperature of 600° C. is high for the temperature range to be used in a sensor; however, no large change in resistance ratio was found even by a heat treatment for 500 hours, and thus, satisfactory results were obtained.

In the case of using a conductive material as a wire rod, the conductive material is likely to be broken along a crystal grain boundary when the crystal grain diameter is coarse. Thus, the crystal grain is required to be fine. The average crystal grain diameter of the samples in Table 1 after the heat treatment at 1550° C. for one hour was investigated. The diameter of each of the samples was set to be ϕ0.3 mm. Expression 2 shows how to calculate an average crystal grain diameter.

$$D=2\times[A/[\Pi(\mu_1+(\mu_2/2))]]^{0.5} \quad \text{Expression 2:}$$

D: Average crystal grain diameter
A: Measurement area
$\mu_1$: Number of crystal grains that are not in contact with the measurement end present in a measurement area
$\mu_2$: Number of crystal grains that are in contact with the measurement end present in a measurement area
Table 4 shows the results.

TABLE 4

| | Average Crystal Grain Diameter (μm) |
|---|---|
| Example 1 | 65 |
| Example 2 | 50 |
| Example 3 | 15 |
| Example 4 | 15 |
| Comparative Example 1 | 105 |
| Conventional Example 1 | 150 |
| Conventional Example 2 | 150 |

As shown in Table 4, in any of Examples 1 to 4, the average crystal grain diameter after the heat treatment was less than 100 μm. Thus, the effect of suppressing the coarsening of crystal grains was recognized. In Comparative Example 1, although the coarsening of crystal grains was suppressed compared with Conventional Examples, such an effect as that in Examples was not obtained. In Conventional Examples 1 and 2, the crystal grains were coarsened irrespective of the presence/absence of Rh, and the grain boundary passing through the wire was present depending upon the observation portion.

The peak other than that of Pt was investigated by X-ray diffraction, and the presence of a precipitate was confirmed. Table 5 shows the results.

TABLE 5

| | |
|---|---|
| Example 1 | Peaks of $Pt_5Sr$ and the like confirmed in addition to Pt |
| Example 2 | Peaks of $Pt_5Sr$ and the like confirmed in addition to Pt |
| Example 3 | Peaks of $Pt_5Sr$ and the like confirmed in addition to Pt |
| Example 4 | Peaks of $Pt_5Sr$ and the like confirmed in addition to Pt |
| Comparative Example 1 | No peak confirmed except for Pt |

In Examples 1 to 4, the peak of an intermetallic compound such as $Pt_5Sr$ was confirmed in addition to Pt, and thus, the presence of a precipitated phase was confirmed. In Comparative Example 1, no peak was confirmed except for Pt.

FIG. 1 shows a surface analysis results by EPMA in Example 3. As shown in FIG. 1, Sr precipitates of about 1 μm and about several hundred nm were confirmed in the surface analysis of Sr.

The present invention described above is formed of a Pt alloy in which 400 to 10,000 ppm of Sr is contained in Pt, and an intermetallic compound phase composed of Pt and Sr is dispersed and precipitated in Pt. Thus, a conductive material used in a resistance wire, a sensor, and the like, which uses a temperature coefficient of a stable resistance ratio, can be provided.

The application of the conductive material of the present invention is not particularly limited, and the conductive material can be used as the material for the conductor which constitutes, for example, the following heaters, resistance temperature detectors, and leads.

(1) heater
(2) resistance temperature detector
(3) resistance temperature detector and heater for a sensor of carbon monoxide and flammable gas
(4) lead for a thermistor
(5) lead for a solid electrolyte gas sensor
(6) lead for a semiconductor gas sensor

What is claimed is:

1. A conductive material formed of a Pt alloy, the material consisting of:

Pt;

600 to 10,000 ppm of Sr; and an inevitable impurity as the balance;

wherein the Pt alloy has been subjected to a heat treatment sufficient to produce an intermetallic compound phase formed of Pt and Sr which intermetallic compound is precipitated and dispersed in Pt; and wherein the conductive material has a stable resistance ratio whose change rate is no greater than 0.02% even after heating the conductive material at 600° C. for 500 hours.

2. A conductor as set forth in any one of the following (1) to (6), wherein the conductor comprises the conductive material according to claim 1:

(1) heater (2) resistance temperature detector (3) resistance temperature detector and heater for a sensor of carbon monoxide and flammable gas (4) lead for a thermistor (5) lead for a solid electrolyte gas sensor (6) lead for a semiconductor gas sensor.

* * * * *